US006055791A

United States Patent [19]

Odum et al.

[11] Patent Number: 6,055,791

[45] Date of Patent: May 2, 2000

[54] APPARATUS FOR INSTALLING A CARRIER ON BEVERAGE CANS AND THE LIKE

[75] Inventors: Thomas M. Odum, Charlotte; Larry H. Baucomb, Mint Hill, both of N.C.

[73] Assignee: Maston Corporation, Charlotte, N.C.

[21] Appl. No.: 09/245,485

[22] Filed: Feb. 5, 1999

[51] Int. Cl.[7] ..... B65B 27/04

[52] U.S. Cl. ..... 53/48.4; 53/556

[58] Field of Search ..... 53/398, 399, 48.1, 53/48.3, 48.4, 534, 556

[56] References Cited

U.S. PATENT DOCUMENTS

| | | | |
|---|---|---|---|
| 3,383,828 | 5/1968 | Cunningham . | |
| 3,742,677 | 7/1973 | Best . | |
| 3,959,949 | 6/1976 | Benno et al. | 53/48.4 |
| 4,070,850 | 1/1978 | Cunningham | 53/48.4 |
| 5,233,811 | 8/1993 | Odum et al. | 53/556 |
| 5,383,321 | 1/1995 | Krogman et al. | 53/556 |

*Primary Examiner*—John Sipos
*Attorney, Agent, or Firm*—Senniger, Powers, Leavitt & Roedel

[57] ABSTRACT

A machine which installs a carrier of elastic material having openings therein onto an end portion of an article such as a beverage can and the like. The machine moves the article generally forwardly relative to the carrier so that a leading edge of the end portion of the article engages the carrier along a portion of the periphery of one of the openings. The carrier is forced by a guide bar downwardly against the end portion of the article so that the carrier tends to be stretched and to be pushed onto the end portion of the article with the end portion being received in the opening. Fingers engaging the carrier in its openings operate cooperatively with the guide bar as the article moves forwardly relative to the carrier to force the carrier against the end portion. The fingers stretch the carrier laterally around the periphery of the end portion as the article moves forwardly relative to the carrier, generally following the contour of the article. The carrier is released by the fingers adjacent a trailing portion of the opening with the carrier resiliently contracting toward the unstretched configuration of the opening and gripping the end portion of the article for holding the article in the opening.

8 Claims, 9 Drawing Sheets

APPARATUS FOR INSTALLING A CARRIER ON BEVERAGE CANS AND THE LIKE

BACKGROUND OF THE INVENTION

This invention relates to a packaging apparatus for installing resilient carriers onto a plurality of containers such as beverage cans and the like.

Many products are sold in containers either as individual items or in a multipack configuration. Such products include soda, beer and other beverages sold in cans. These items are frequently packaged and sold in carriers consisting of a web of film having a plurality of container receiving apertures with each aperture being adapted and sized to receive and grip an upper portion of the container. The consumer will then grasp a portion of the carrier for carrying the plurality of containers. The web is resilient and grips the cans in the opening and when the consumer is ready to use one of the containers, the consumer simply removes the container from the web. Presently, packaging of such containers is done at the manufacturing plant using equipment that is long and complicated and too expensive for an independent store to own. However, a store owner may desire to package containers purchased in packages containing a large number of cans in smaller numbers in such a carrier. However, this is difficult to do manually with or without tools. Thus, there is a need for a machine that will quickly and economically package containers in such a carrier. Such a machine is disclosed in U.S. Pat. No. 5,233,811, which is similar in design and function to the apparatus disclosed herein.

SUMMARY OF THE INVENTION

Among the several objects and features of the present invention is the provision of an apparatus for installing a carrier onto articles such as beverage cans and the like which operates automatically, is small and economical and efficient in operation; the provision of such an apparatus which can be adapted for handling multiple sizes of containers without modification to the apparatus.

The apparatus as disclosed herein is operable for installing a carrier comprising a web of elastic material having openings therein onto the upper portions of articles such as beverage cans or the like. The openings in the web are smaller than the periphery of the containers whereby when the container is inserted into the web, the web will elastically deform and because it is resilient, will frictionally grip an upper end of the container. The apparatus as shown will feed in an index manner two rows of containers into the web with the web being tensioned and being generally planar but having the outer marginal edges turned downwardly prior to inserting the containers into the openings. A centrally located elongate bar holds the web at an elevation lower than the top of the containers forcing a portion of the web onto the containers and finger members engage portions of the periphery of the openings leveraging the remainder of the margins around each opening onto the container. After a predetermined number of containers are inserted into the web, the web in then cut to form individual carrier-container combinations. The apparatus is adapted for handling multiple sizes of containers without modification to the apparatus except for putting on a new size carrier web.

Other objects and features of the present invention will become apparent and in part are pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
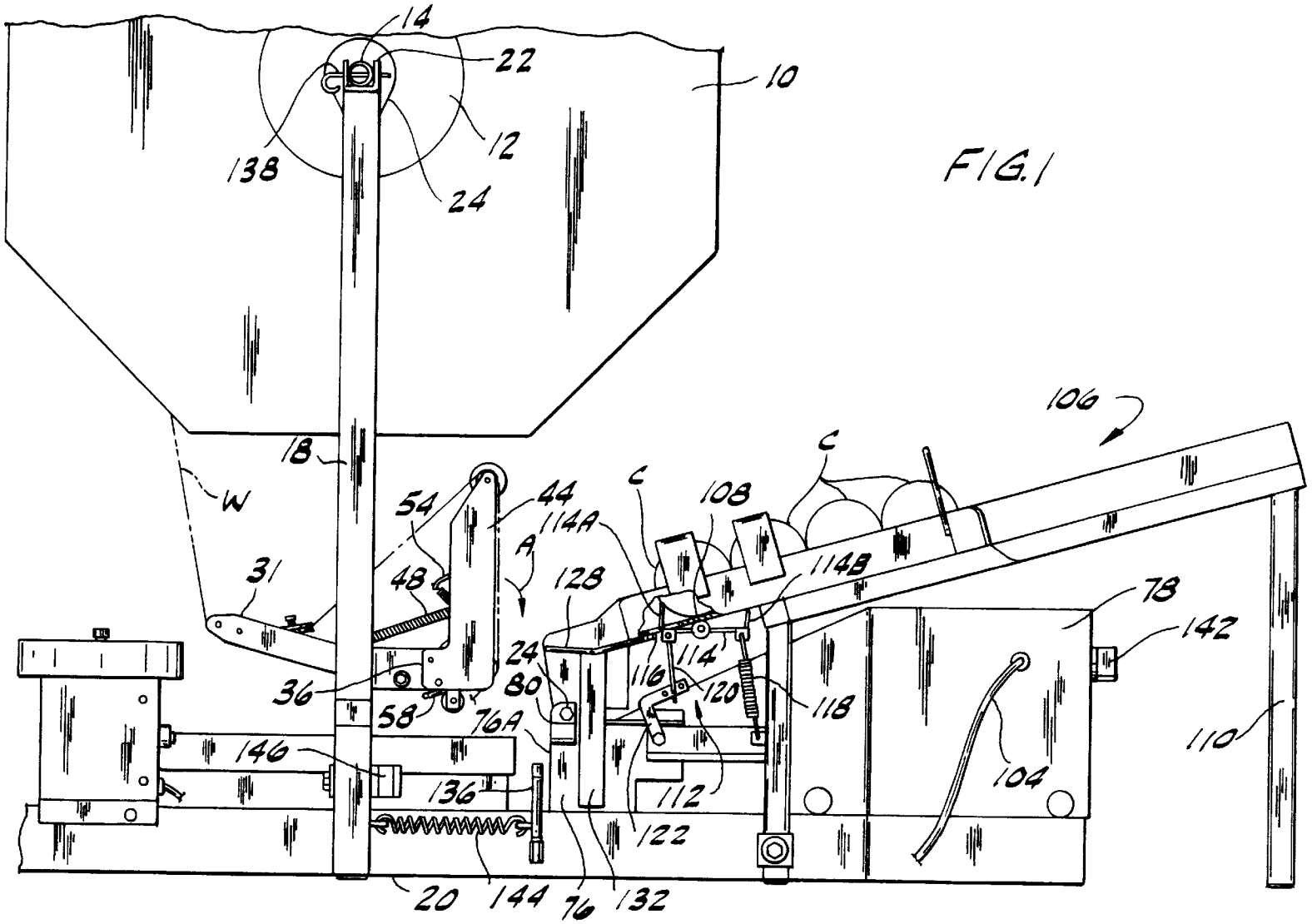
FIG. 1 is an elevation of the machine holding a spool of a carrier for installation on articles such as beverage cans, parts of the machine being broken away to show details thereof.

A web for forming carriers for articles such as generally cylindrical beverage cans C is shown to comprise an elongate strip or web W of resilient elastic material having openings O which are shaped in size for receiving an upper end portion U of the container C. The openings O are arranged in pairs of laterally aligned openings spaced by a central portion of the web. A preferred web is disclosed in copending patent application Ser. No. 09/245,608 filed Feb. 5, 1999 to Thomas M. Odum and Larry Baucomb and entitled "Multi-Container Package and Carrier Device", the disclosure of which is incorporated herein by reference. In the relaxed configuration of the web W, each opening O has a circumference or perimeter smaller than the perimeter of the upper end portion U of the can C so that the web must be stretched to enlarge the opening for receiving the upper end portion. Once a container is installed in one of the openings O, the resilient web grips the can tightly and holds the can from falling out of the opening. As shown in FIG. 1, the carrier is supplied in a roll on a spool pin supported on hubs 12 mounted on an axle 14 extending through the center of the spool. The carrier installing section of the apparatus is designated generally at 16 and is operable for installing the carrier onto the containers. A stanchion 18 extends upwardly from the channel-shaped base 20 which has two side walls 20A and a bottom wall 20B extending between the side walls 20A. The axle 14 is supported for rotation at the upper end of the stanchion 18. If a spool brake is needed, a disc-shaped extension 22 of the axle can be provided on one side of the spool to provide a friction surface along its circumference to resist rotation of the spool 10. A belt 24 can be mounted on the stanchion 18 to extend around the disc-shaped extension 22 and bear against it and resist rotation and unrolling of the web. The web W as shown passes partially around and under a guide bar 30 mounted on a frame 31 and then over the top and partially around a guide bar 32. The guide bars 30 and 32 are suitably mounted on the frame 31 which is also supported by the stanchions 18. Pivotally mounted on the frame 31 are friction applying means generally designated as 33, which friction means 33 are operable to engage lateral margin portions of the web W to apply tension to the web W in a preselected amount. The friction means 33 are in a leading or upstream position relative to the container inserting station hereinafter described. As seen, the friction means 33 includes two jaws 26 and 27, with the jaw 27 being pivotally mounted on the frame 31 at 28. Preferably, the jaws have adjacent surfaces that generally conform in shape to engage the web. An adjustable force can be applied between the jaws 26 and 27 to the web W by means of a spring 29A with a pin 29 through it. The friction means 33 are operable such that friction engagement with the web can be provided selectively when the machine is operating and released to assist in loading the web W between the jaws 26 and 27. Preferably, there is a friction means 33 on each of the lateral edge margins of the web W. Also mounted on the frame 31 are guide bars 35 and 37 with the guide bar 35 having guide collars 35A mounted on and spaced a distance approximately equal to the width of the web W which help guide the web W and maintain it generally centrally located for feeding into the container inserting station. The web passes over and partially around the guide bar 35 and then partially around and under the guide bar 37. Preferably, the friction means 33 provides sufficient friction to keep the web taut and it has been found that the applied force to continue moving the web through the friction means should be on the order of two to three pounds, preferably 2½ pounds of force to maintain the movement.

Figure 3:
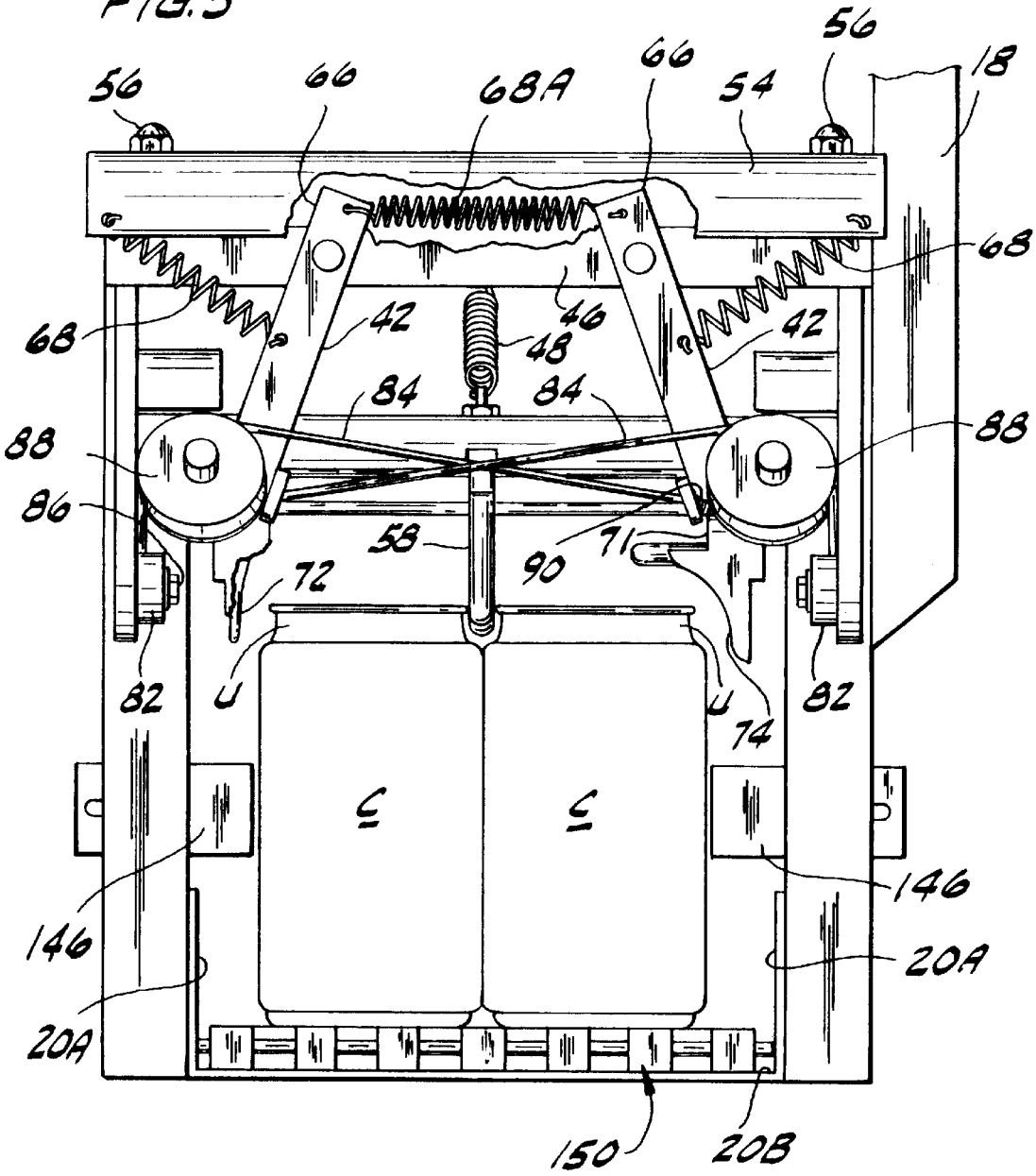
FIG. 3 is a section taken in the plane along lines 3—3 of FIG. 1.

Referring now to FIG. 3, the carrier installing mechanism 34 includes struts 36 attached by welding to the stanchion 18 and extending rearwardly toward the container inserting section. The shaft 69 extends transversely of the apparatus 16 through the ends of the cross bar 50 to allow pivoting movement of the members 44. Fingers 42 are mounted on the first and second laterally spaced members 44 and a cross support 46 extending transversely between the distal ends of the members 44. The members 44 mounted on the struts 36 of the shaft 38 which passes through an opening in each of the members and permits pivoting motion of the members and cross support on the shaft about its longitudinal axis. A tension spring 48 is attached to the cross support 46 at one end and the U-shaped crossbar 50 extending from the stanchion 18 at its other end and biases the members 44 and the cross support 46 to the upright position as shown in FIG. 1. A cover 54 of inverted U shape and cross-section extends transversely of the machine 16 and is mounted at the upper ends of the members 44 by studs (not shown) and knobs 56 threaded onto the ends of the studs and provide a cover for the springs thereunder. The web W extends over and part way around the first guide roll 35 and then around the guide roll 37.

Figure 8:
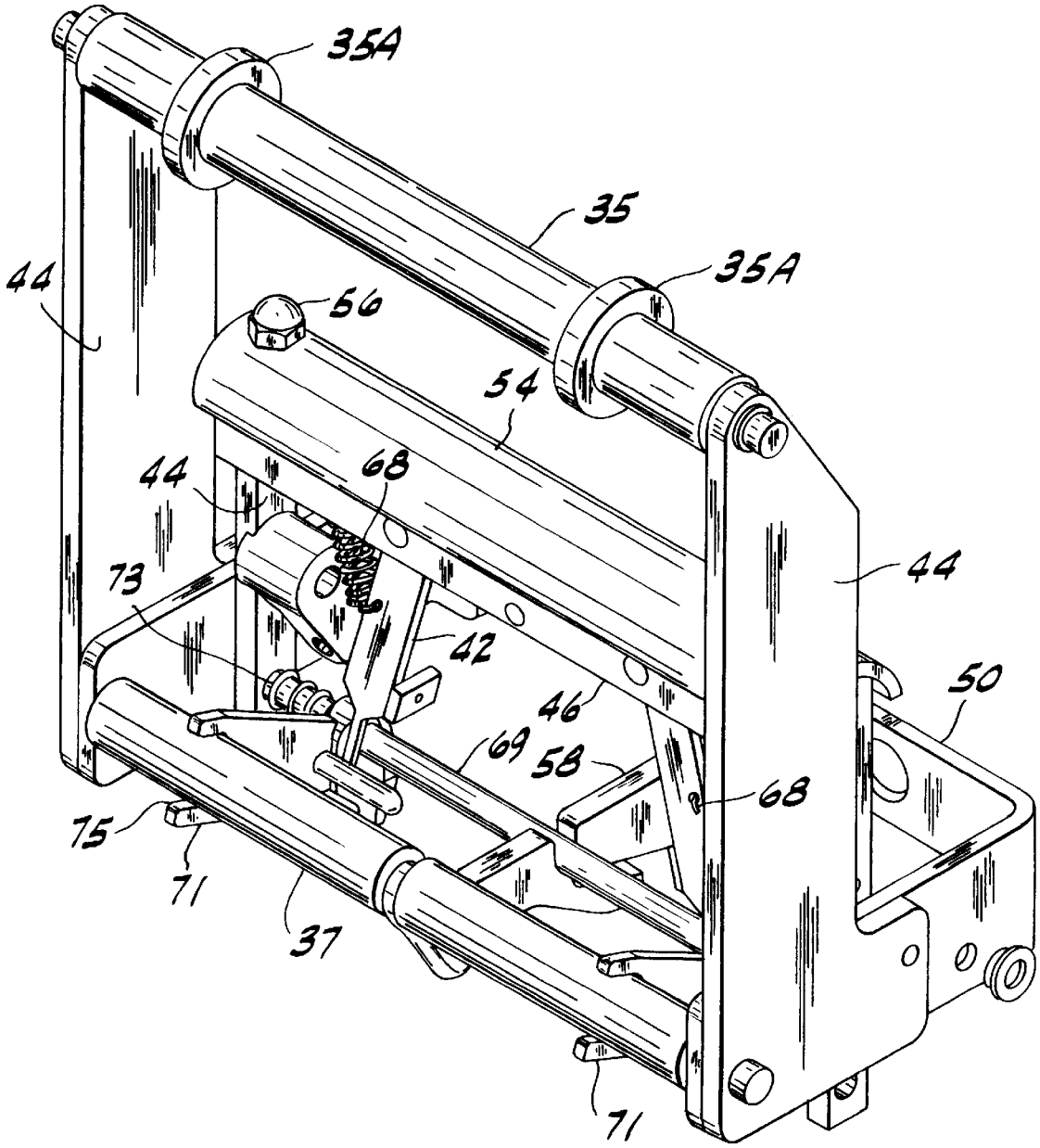
FIG. 8 is a perspective view of a portion of the web feeder.
Figure 9:
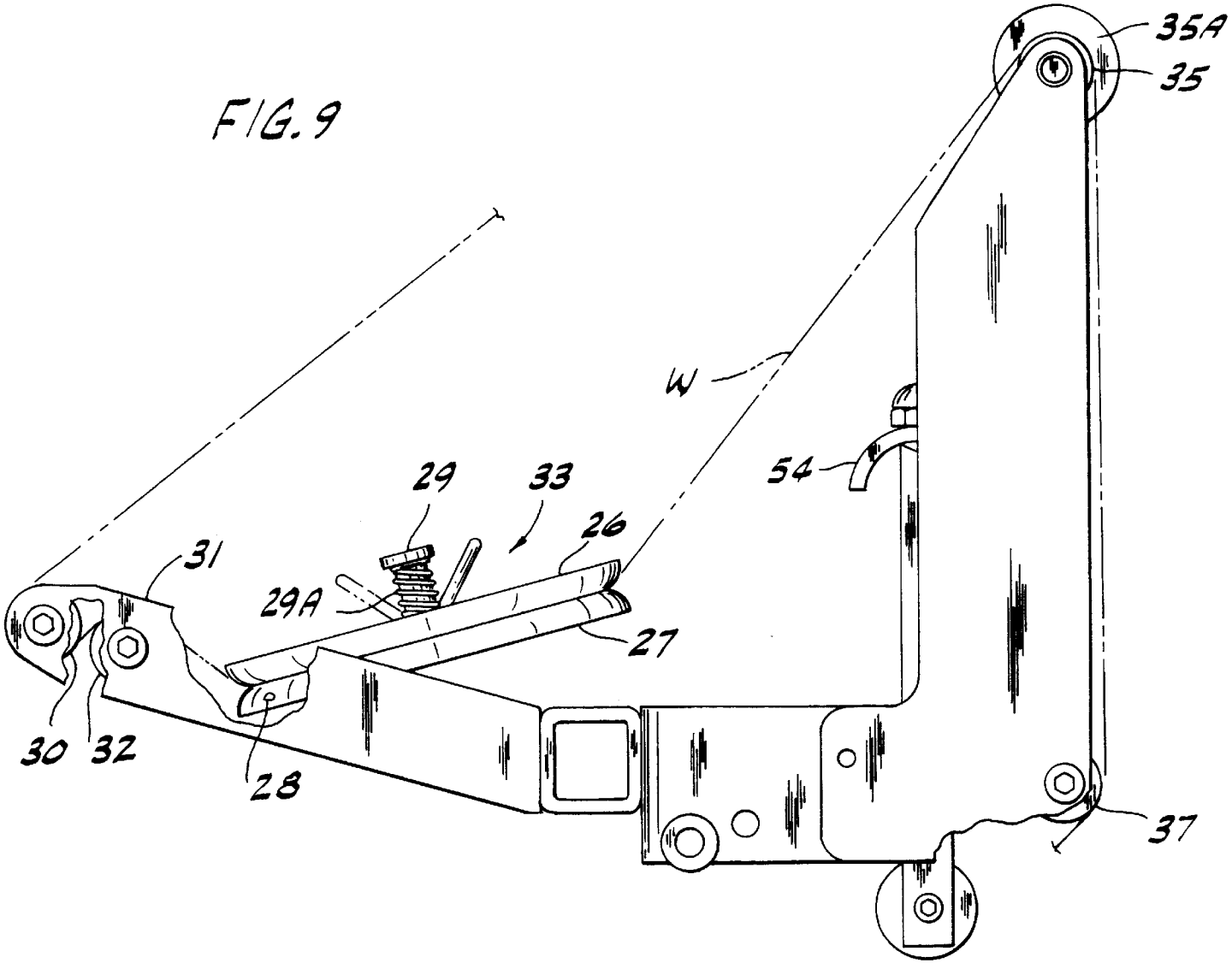
FIG. 9 is a side elevation view of a portion of the web feeder.
Figure 10:
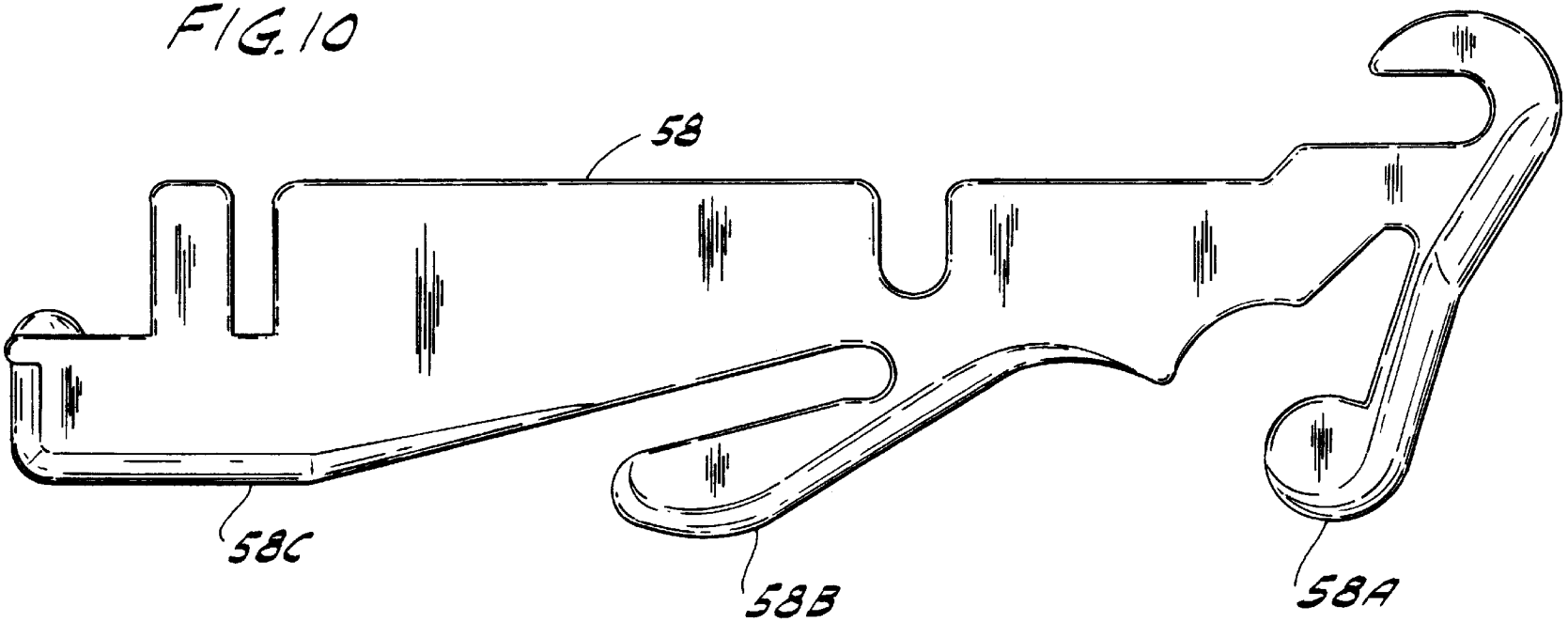
FIG. 10 is a side elevation of a web guide bar.

The guide bar 58 is positioned generally centrally between the two rows of containers and is suitably mounted on the machine and as shown has one end thereof mounted on the guide bar 37 depending downwardly therefrom and rearwardly toward the container inserting section. The center portion of the web will engage the guide bar 58. The lower edge of the guide bar 58 has its leading edge 58A sloping downwardly and into the container inserting section as seen in FIG. 8. This nose portion or finger 58A is a downwardly projecting finger that preferably is integral with the guide bar 58 and is elastically deformable forming a cantilever spring. The web will then pass from the finger 58A to a second portion of the guide bar 58 which is also a cantilever spring section or finger 58B followed by a third web engaging portion 58C. The elevation of the bottom surfaces of these members 58A, 58B and 58C, is below the top of the container C. The web passes under the members 58A, 58B and 58C. When the finger 58A engages the central opening in the web, the web moves upwardly to allow containers to move forward without yet engaging the web. The leading edges of the containers will then engage the web openings and by moving forward will pull the web further into the machine. As the web moves with the containers, the fingers 58A and 58B have distal ends thereof re-engage the center of the web with the finger 58B pushing the web down onto the container and the finger 58A moves the trailing portion of the web downwardly to assist in inserting the web onto the containers. The third section 58C maintains the center of the web in a down position on the inside periphery of the containers passing through the container inserting section and keeps the cans in their tracks, upstanding and spaced apart.

The fingers 42 are each mounted adjacent their respective upper ends to the cross support 46 of the support frame at laterally spaced locations by suitable fasteners 64 for pivoting generally laterally about axis extending longitudinally of the machine 16. Tensioning members 68 such as springs have one end each attached to a respective finger 42 and to the cover 54 which is suitably mounted on the frame 31. A tensioning member such as a spring 68A is connected to both of the fingers 42 adjacent ends 66 to bias the fingers 42 to an expanded position. These springs apply force to the fingers biasing them to a laterally outward position. The fingers 42 also have a rod 69 extending therethrough to prevent longitudinal movement of the fingers during operation. As is best seen in FIGS. 5A–5D the fingers each have an end portion 72 which is generally hook-shaped and is adapted to engage the peripheral edge portion of the openings O on top of a bight portion 72A for encouraging or forcing the web to expand at the opening O and keep the web stretched about the opening O so the finger 58B can push the web onto the container for the final insertion of the container into the web.

Plows or upsetters 71 are slidably mounted on the rod 69 with the plows 71 being substantially identical but mirror images of one another. As the fingers move in and out laterally, the plows will likewise move in and out biased by springs 73 also mounted on the rod 69. Each plow 71 has a follower surface 74 which is operable for engaging an edge of the web and is curved to induce the margin of the web to turn downwardly when the plow 71 moves inwardly as biased by the spring 73. As the fingers 42 move inwardly, the springs 73 bias the plows 71 inwardly to fold the margin downwardly to ensure proper inserting of the containers into the openings of the web. The plows 71 also have a notch 75 in a free end thereof which are slidable on the guide bar 37 to prevent their rotation about the rod 69. Also, the plows 71 have a projecting pin 75B that will be positioned at approximately the height of the container passing thereby to prevent the web from rising above a predetermined position and to keep the margins of the web turned down. If the web margin turns up, it will stretch differently and may break when the cans are inserted into the web openings.

Figure 7:
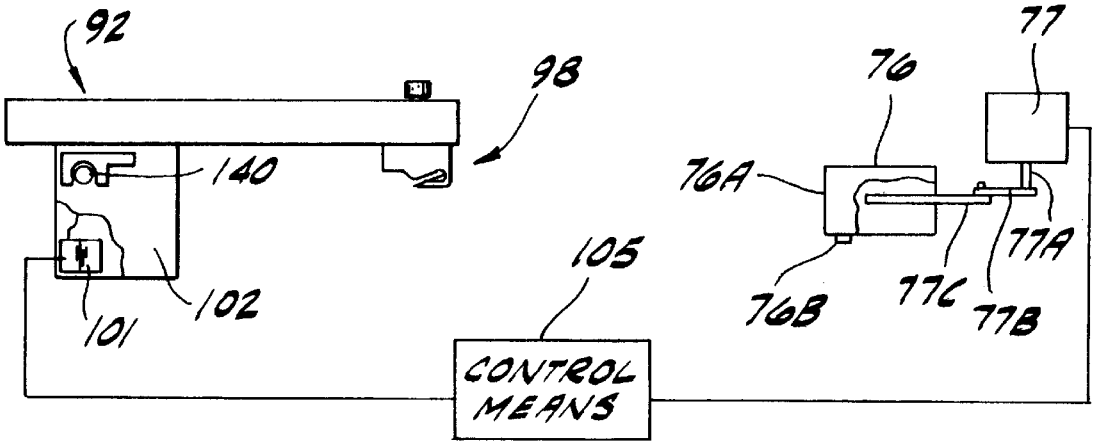
FIG. 7 is a schematic illustration of control means for the cutter.

A reciprocating drive arm 76 (broadly moving means) of the machine 16 pushes the cans C generally in a forward direction relative to the carrier web W. The drive arm 76 is generally box shaped and has a forwardly facing flat surface 76A adapted to simultaneously engage two of the containers C for pushing them forward. An electric motor 77 located in housing 78 at the rear of the machine has an outlet shaft 77A which is attached to the drive arm 76 by a first link 77B fixed to the shaft for conjoint rotation, and a second link 77C pivotally connected to the first, to convert the rotary motion of the shaft into the reciprocating motion of the drive arm (FIG. 7).

Figure 5A:
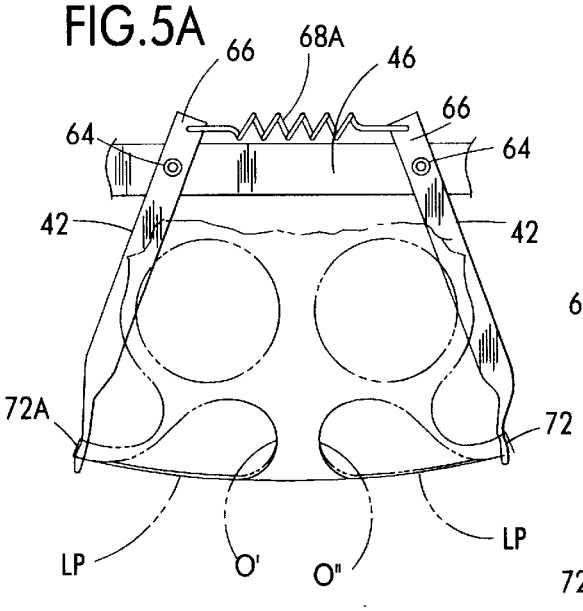
FIGS. 5A–5D schematically illustrate the sequence of carrier installation on beverage cans from line 3—3 of FIG. 1.

Rollers 76B mounted on the drive arm 76 and riding on the bottom wall 20B of the base 20 support the drive arm at its forward end. The drive arm 76 is operable to simultaneously push leading edges of the upper end portions of the two cans into engagement with leading portions LP of the peripheries with the respective openings O of the laterally aligned openings in which the fingers 42 are engaged (FIG. 5A). Continued movement of the drive arm 76 and cans C causes the carrier web to be forced downwardly and laterally outwardly around the upper end portion of U of each container. Upstanding ears 80 mounted on the forward end of the drive arm 76 engage corresponding roller cams 82 mounted on the portion of the members 44 below the shaft 38. This engagement causes the members 44 and crosspiece 46 of the carrier installing mechanism to pivot rearwardly on the shaft 38 in the direction indicated by the arrow A in FIG. 1 from the initial upright position against the bias of the tension spring 48 to a position which the members are approximately 30° from the horizontal. This pivoting action causes the fingers 42 which are tethered to the struts 36 by cables 84 to pivot laterally inwardly on their connections to the crosspiece 46. Each cable 84 is connected at one end by a bolt 86 to an upper end of one of the members 44 and extends over a cable guide 88 mounted on a respective strut 36 to the finger 42 furthest from the strut. The cable 84 and cable guide 88 constitute means for pivoting the fingers 42 laterally inwardly in this embodiment. The fingers 42 each engage the periphery of the web W about equal distance between the leading and trailing edges and circumscribes about ¼ of the periphery of the container prior to exiting from the opening. While the fingers are moving inwardly, the plows 71 also move inwardly with the fingers keeping the margin of the web downwardly turned and retained therebetween. As the members 44 and crosspiece 46 pivot rearwardly as indicated by arrow A, the distance between the member and the cable guide 88 decreases so that the cable is pulled over the cable guide toward the bolt 86. A stop 90 on the end of the cable 84 engages the finger 42 causing it to swing laterally inwardly. As explained more fully below, this action allows the fingers to release the web W after installation on the cans C. As seen, the end portion 70 of the fingers is bent forming a shoulder 72A on which the web rides during installation.

Figure 6:
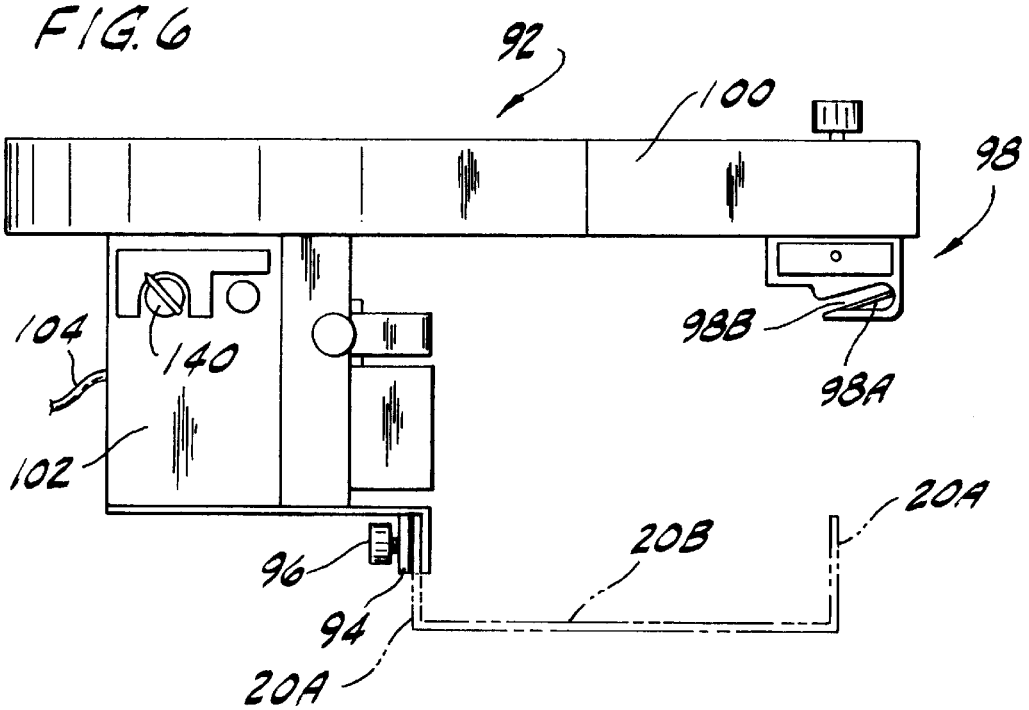
FIG. 6 is a section view taken in a plane along line 6—6 of FIG. 1 showing a cutter.

The carrier installing mechanism 34 and drive arm 76 are operable to install the carrier web W on the upper end portions U of the containers C continuously for substantially the entire length of the carrier web. To selectively sever portions of the carrier web W from the remainder of the roll after installation on a predetermined number of containers C an automatic cutter can be provided or an operator may simply sever the web with a suitable knife. An automatic cutter generally indicated 92 is provided and as shown is mounted on one side of the side walls 20A of the base of the machine 16. As seen in FIG. 6, a narrow channel 94 at the bottom of the cutter 92 receives an upper portion of the side wall 20A and is releasably secured to the side wall at a selected location in a suitable manner such as by a set screw 96. The cutter 92 includes a knife indicated generally at 98 mounted on a track 100 for motion transversely of the base 20. The knife 98 includes a blade 98A which is recessed in a slot 98B. The knife 98 is driven transversely over the base 20 by an electric motor 101 in a housing 102 which supports the track 100 and knife 98. The web W is received in the slot 98B as the knife moves over the base and is severed by its engagement with the blade 98A. The electric motor 101 is releasably connected to a power supply by cord 104. Through its plug in connection, a sensor 105 (broadly control means) counts the revolutions of the output shaft 77A and activates the motor 101 when the revolutions correspond to a predetermined number of cans C to be packaged together to sever the carrier web W. The motor 101 automatically cycles the knife 98 to return to its start position after the cut is made.

Figure 2:
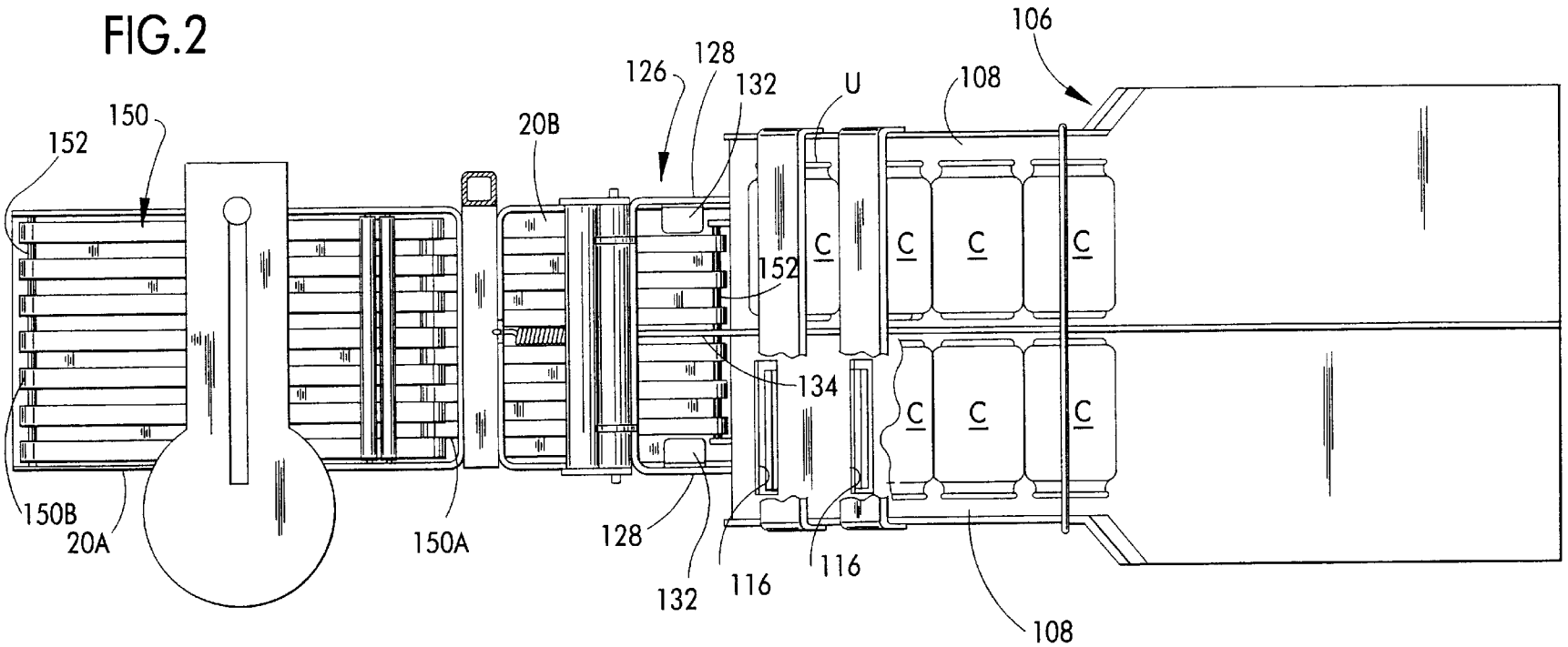
FIG. 2 is a plan view of the machine without the spool.

The machine 16 is constructed for holding a plurality of cans C on which the carrier is to be installed. An inclined rack indicated generally at 106 (broadly "means for delivering articles"), having two channels 108, is mounted on the base 20 generally above the drive arm 76 and housing 78. A leg 110 at the rear of the rack 106 supports a portion extending rearwardly of the base 20. Each of the channels 108 is wide enough to receive one of the cans C lying on its side so that it tends to roll down the rack 106 under the effect of gravity. As shown in FIG. 2, several of the cans can be loaded in a row in each channel 108. A gate mechanism, generally indicated at 112, adjacent the forward end of the rack 106 feeds the cans to the base 20 two at a time. The gate mechanism 112 includes a rocker arm 114 mounted on the underside of the rack for pivoting motion about a transverse axis. The rocker arm 114 has a pair of front gates 114A (one for each channel) at its forward end and a pair of rear gates 114B at its rearward end. Each of the gates 114A and 114B is receivable through one of four slots 116 (only two are shown) in the bottom of the rack 106 into one of the channels 108. The rocker arm 114 is biased by a spring 118 attached at one end to the rear of the rocker arm and at an opposite end to the base 20 to a position in which the rear gates 114B are withdrawn from their slots 116 and the front gates 114A protrude through their slots (i.e., the position illustrated in FIG. 1). In this position, the front gates 114A engage and hold respective rows of cans C from forward motion. The forward end of the rocker arm is attached by a link 120 to a lever arm 122 pivotally mounted on the base 20. The lever arm 122 has a camming portion engagable with another cam 124 mounted on and projecting laterally outwardly from the drive arm 76. Rearward motion of the drive arm 76 underneath the rack 106 causes the cam 124 to engage the lever arm 122 so that the rocker arm 114 pivots forwardly against the bias of the spring 118, thereby extending the rear gates 114B through their respective slots just behind the forwardmost cans C in the channels 108 and withdrawing the front gates 114A.

Once released by the front gates 114A, the fowardmost cans C roll off the end of the rack 106 and are turned upright by can erecting structure indicated generally at 126. The can erecting structure 126 for each channel 108 of the rack includes a forwardly extending side bar 128, a transversely extending front bar 130 and a rigid S side flap 132 depending from the side bar. The front bar 128 is arranged to stop the forward motion of the can C and a center piece 134 prevents the cans from engaging each other after leaving the rack 106. The laterally outer (i.e., upper) portion of the can rolls onto and is supported by the side bar 128 while the laterally inner (i.e, lower) portion of the can is unsupported. Thus, the laterally inner portion of the can falls toward the base 20 ahead of the laterally outer portion so that the can pivots on the side bar 128 to an upright position. The side flap 132 is angled inwardly to guide the can toward the base 20. A pair of doors 136, one pivotally mounted on each side wall 20A of the base, retains the lower ends of the cans from sliding forward when they fall. The cans C are then positioned for engagement by the flat surface 76A of the drive arm 76. The cam 124 disengages the lever arm 122 upon forward motion of the drive arm 76, thereby releasing the rocker arm 114 to swing back to its position with the front gates 114A protruding through their slots 116 into the channels 108 and the back gates 114B withdrawn from their slots. The cans C in each channel 108 roll down so that the forwardmost cans engage the front gates 114A and are disposed for feeding to the base 20.

Operation

The operation of the machine 16 is better understood by reference to FIGS. 4A–4C and 5A–5D, schematically illustrating the operation of the carrier installing mechanism 34. To begin operation, a spool 10 holding a roll of the carrier web W is loaded with the ends of its axle 14 supported at the upper ends of the stanchions 18. The spool hubs 12 are secured in place by a cotter key 138 inserted through an opening adjacent one end of the axle 14. The carrier web W is fed down from the spool 10 under the take-up bar 30 and thence forwardly over and partway around the guide 31 and thence through the jaws 26 and 27. The carrier web W is brought upwardly and partly around to the guide 35 and partway around the guide bar 37 to and between the plows 71 and into engagement with the guide bar 58 and the fingers 42. One of the fingers 42 is received in one opening O' of a pair of laterally aligned openings O in the carrier web W with a portion of the web engaged in the hook-shaped portion 72 of the finger (FIG. 5A). The other finger 42 is received in the opposite opening O" with a portion of the web W engaged in the hook-shaped portion 72 of the opposite finger. The fingers 42 hold the leading portion of the web W and stretch the web and openings O', O" laterally outwardly.

Prior to initiating installation of the carrier on the cans, the cutter 92, when used, is set by turning a control knob 140 on its housing 102 to the number of cans C desired in each package of cans on which the carrier web W is to be installed (e.g., six cans). Cans C are loaded on their sides into the rack 106 in two rows, one in each channel 108. The channels 108 are sized to receive cans of different heights. The cans 108 roll forwardly until the forwardmost cans engage the front gates 114A of the rocker arm 114. The machine 16 is now prepared to begin installing the carrier web W onto the cans C.

Pushing a control button 142 at the rear of the housing 78 activates the electric motor which starts to move the drive arm 76 rearwardly along the base 20. The cam 124 on the drive arm engages the lever arm 122 of the gate mechanism 112 and the rocker arm 114 swings forwardly releasing the forwardmost cans as described above. The forwardmost cans C in each channel 108 roll forwardly and fall down to the base, being set upright by the erecting structure 126 in front of each rack channel 108. The drive arm 76 reverses direction and the cam 124 disengages the lever arm 122 to permit the rocker arm 114 to swing to its spring biased position. The rear gates 114B are withdrawn from the channels 108 and the front gates 114A exposed so that the cans C in each channel roll down until stopped by the front gates.

Figure 4A:
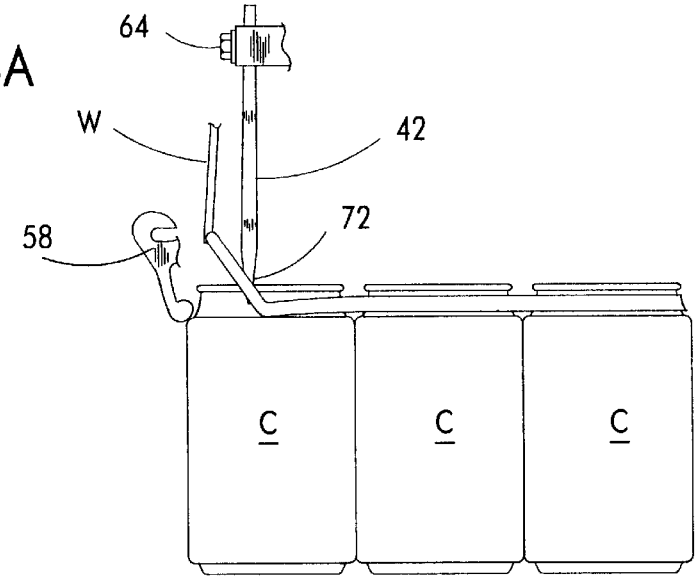
FIGS. 4A–4C schematically illustrate the sequence of carrier installation on beverage cans in side elevation.
Figure 4B:
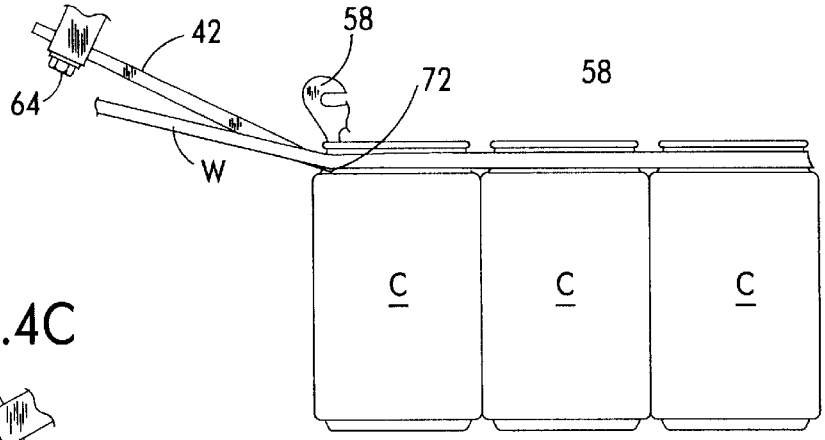
Figure 5B:
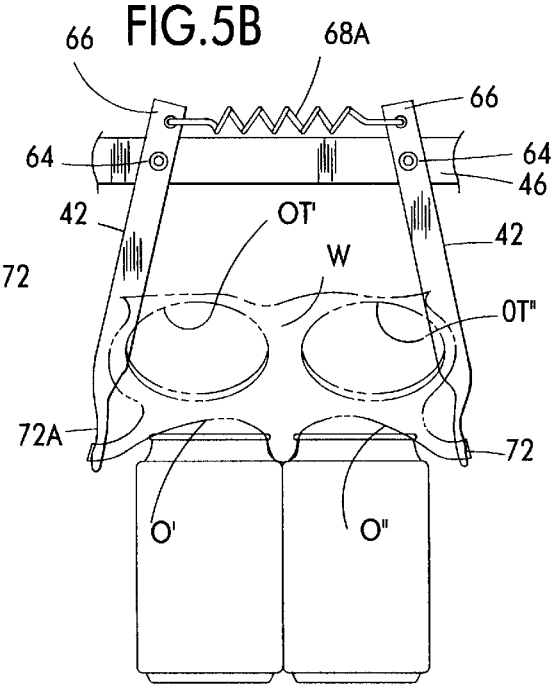

The drive arm 76 pushes the cans C through the doors 136, which swing open against the bias of springs 144, and toward the carrier installing mechanism 34. Leading edges of the upper end portions of the cans engage the carrier web W along leading portions LP of respective openings held by the fingers 42 (FIGS. 4A and 5A). As the cans C continue to move forward, they pull the web and the fingers 42 move into engagement with the cans (FIGS. 4B and 5B). The fingers 42 enlarge the openings O by stretching the web laterally outwardly around the upper end portion U of the cans, generally following the contour of the can. The web W at the periphery of the openings O', O" slides over the fingers 42 as the cans, now in engagement with the web, carries the web forwardly. At the same time, the cans C pass alongside the guide bar 58 which is disposed at a height above the bottom wall 20B of the base less than the height of the cans and which engages a central portion of the carrier web W between the laterally aligned openings. The guide bar 58 guides the web W downwardly relative to the cans and forces the web against the cans. The finger 58B starts the web onto the can and continues to push the web onto the container while the fingers 72 move around a portion of the container to help complete insertion of a can into an opening. The web W tends to stretch as the cans C are forced against it and to be pushed onto the cans with the upper end portions U of the cans received in respective openings O', O". The hook-shaped portions 72 of the fingers 42 are also located at a height lower than the height of the cans C so that they tend to keep the web at an elevation and in a stretched condition to assist in inserting the containers into the web.

Figure 4C:
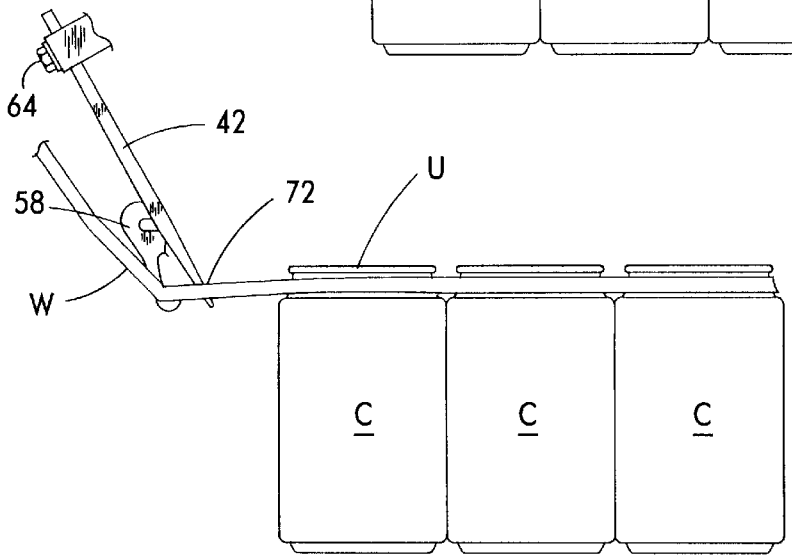
Figure 5C:
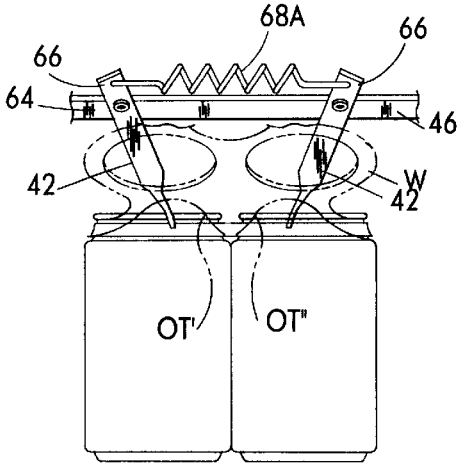

The ears 80 of the drive arm 76 engage the roller cams 82 and the lower ends of the members 44 of the carrier installing mechanism 34 causing the members, cross piece 46 and fingers 42 to swing forwardly (FIGS. 4C and 5C). At the same time the cables 84 tethering the fingers 42 to the members 44 cause the fingers to swing laterally inwardly generally at the trailing portion of the cans C and openings O', O". At this point the cans C are subjected to significant forces which tend to cause the cans to move rearwardly and shift laterally in the base. Adjustable can guides 146 mounted on the stanchion 18 engage the cans C to prevent substantial lateral movement. The can guides 146 are adjustable laterally inwardly and outwardly so that the machine 16 may be set up to receive cans of different sizes. The reorientation of the fingers 42 caused by the movement of the support frame places the fingers in a nearly horizontal position for releasing the carrier web W, which slips out of the hook-shaped portions 72 generally at a trailing portion of the opening. The web W resiliently contracts toward the unstretched configuration of the openings O and grips the upper end portions U of the cans C for holding the cans in the openings.

Figure 5D:
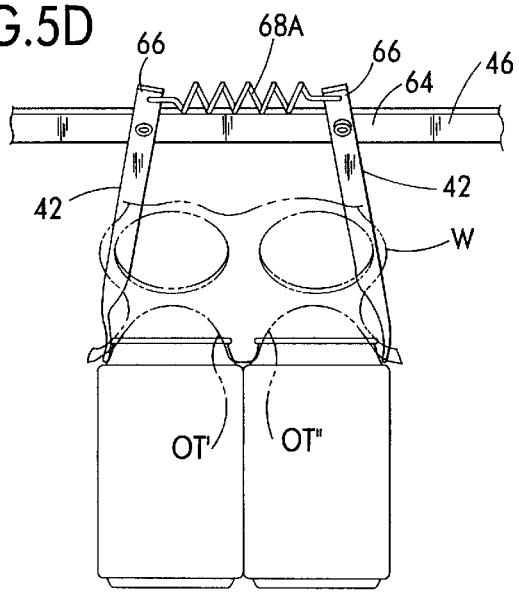

The drive arm 76 moves rearwardly, disengaging the roller cams 82 at about the same time the fingers 42 release the web and allowing the tension spring 48 to draw the fingers, members 44 and cross piece 46 of the installing mechanism 34 to their original upright position. The cables 84 are loosened allowing the tension spring 68 connecting the upper ends of the fingers 42 to swing them laterally outwardly away from each other as the support frame swings to its upright position. The carrier web W is held taut between the cans C and around the guides 35 and 37. The arc of the hook-shaped portions 72 of the fingers 42 as they swing outwardly brings them into respective openings OT', OT" of a trailing pair of laterally aligned openings (FIGS. 4C and 5D). The hook-shaped portions 72 catch the web W along a generally laterally outer portion of the periphery of these trailing openings toward the side of the openings and stretch the openings outwardly in preparation for receiving the next pair of cans.

The drive arm 76 continues to move rearwardly, allowing springs 144 to swing the doors 136 to shut. Eventually, the cams 124 on the drive arm 76 re-engage the lever arm 122 of the gate mechanism 126 and a second cycle of operation begins. The second cycle of the apparatus includes the same operations (except the initial threading of the web and loading of the cans C into the rack) as the first, and results in a second pair of cans being installed in the trailing openings. As cans C continue to be packaged by the carrier, their number is counted by the sensor 105. When the preselected number of cans C has been counted, the electric motor 101 in the housing 102 is activated to move the knife 98 across the web W between pairs of cans to sever the portion of the web forward of the knife from the roll. The cans C are now packaged in an easy to carry number for sale.

As previously stated, the carrier installing machine 16 may be reconfigured to package cans C of different heights. It is important that the upper end portions U of the cans be located above the guide bar 58 and lower ends of the fingers 42. Therefore, if the cans C are shorter, a floor indicated generally at 150 on the bottom wall 20B of the base 20 is provided to raise them to the necessary height (FIG. 2). The floor 150 includes two sets of slats, designated 150A, 150B, respectively, each set of slats being connected together by a connecting rod 152 at one end thereof and free at the opposite end. The slats 150A, 150B have a thickness selected to raise the level of the upper end portions U of the cans to the necessary height. It is to be understood that several sets of slats may be provided for configuring the machine 16 for cans of several different heights. A first of the sets of slats 150A is installed over the bottom wall 20B with its connecting rod 152 connected to the drive arm 76 and the slats extending forwardly therefrom. A second of the sets 150B is positioned with its connecting rod 152 extending laterally between the side walls 20A at the forward end of the base. The slats of the second set 150B extend rearwardly from their connecting rod 152. The slats of each set 150A, 150B are spaced laterally of each other and arranged with respect to the slats of the other set so that upon forward movement of the drive arm and first set of slats 150A, the slats of both sets interdigitate. The construction of the floor 150 allows the first set of slats 150A to reciprocate with the drive arm 76 and yet provide a continuous surface to support the cans. The slats 150A, 150B are made of a smooth material such as graphite to prevent wear on the bottom wall 20A.

As various changes could be made in the above constructions without departing from the scope of the invention, it is intended that all matter contained in the above description or shown in the accompanying drawings shall be interpreted as illustrative and not in a limiting sense.

What is claimed is:

1. An apparatus for installing a carrier comprising a web of elastic material having openings therethrough onto an end portion of a container such as a beverage can and the like, each opening of the web being smaller in perimeter than the perimeter of an end portion of the container such that the web must be stretched to enlarge the opening for receiving the end portion, the apparatus comprising:

a) first means for moving a plurality of rows of containers forwardly into a container inserting station and at least initially moving relative to the carrier web so that a leading edge of an upper end portion of the container engages the web along a portion of the periphery of laterally adjacent openings;

b) a mount operable for holding an elongate strip of web;

c) web directing means operable for directing the web into the container inserting station;

d) grippers each operable for frictionally engaging side margins of the web and cooperating with the first means to apply tension in the side margins between the grippers and the first means;

e) a guide positioned between the grippers and the first means and positioned to engage the web between the rows of article and having a lower web engaging edge positioned at a height below the tops of the articles for assisting in inserting articles into openings in the web;

f) plows positioned on opposite sides of the web for engaging the side margins between the grippers and the container inserting station for folding the side margins downwardly; and g) finger means adjacent the container inserting station for engagement with an outer edge of an opening in each row and operable as the containers move thru the container inserting station to generally follow a portion of the exterior of the top of the container to stretch the web and cooperating with the guide to force the web onto the container and releasing the web adjacent a trailing edge portion of a respective opening in the web, said finger means being constructed and arranged for entering a trailing opening and engaging an outer portion thereof.

2. An apparatus as set forth in claim 1 wherein:

a) said guide includes two resilient fingers on the lower edge thereof with each finger having a web engaging distal end portion and depending downwardly from the guide and operable to selectively engage portions of the web.

3. An apparatus as set forth in claim 2 wherein:

a) said distal end portions being spaced apart a distance that they can both selectively and simultaneously engage center portions of the web between adjacent lateral rows of container openings and simultaneously extend into adjacent center openings in the web.

4. An apparatus as set forth in claim 3 wherein:

a) said guide is made of a polymeric material and said fingers are integral therewith.

5. An apparatus as set forth in claim 2 wherein:

a) said grippers each include two adjacent friction members each having a frictionally engaging surface generally conforming in shape to one another for receiving a respective margin therebetween and frictionally engaging opposite surfaces of the margin, said grippers each including means to adjust the friction force applied to the respective margin.

6. An apparatus as set forth in claim 2 wherein:

a) said plows are each mounted on a slide and are operably connected to drive means operable to laterally move the plows relative to the margins.

7. An apparatus as set forth in claim 1 wherein:

a) said grippers each include two adjacent friction members each having a frictionally engaging surface generally conforming in shape to one another for receiving a respective margin therebetween and frictionally engaging opposite surfaces of the margin, said grippers each including means to adjust the friction force applied to the respective margin.

8. An apparatus as set forth in claim 7 wherein:

a) said plows are each mounted on a slide and are operably connected to drive means operable to laterally move the plows relative to the margins.

* * * * *